US008216040B2

(12) United States Patent
Tobias et al.

(10) Patent No.: US 8,216,040 B2
(45) Date of Patent: Jul. 10, 2012

(54) WAGERING GAME

(75) Inventors: Michael Tobias, Oro Valley, AZ (US); Brendan P Gardener, Fernandina Beach, FL (US)

(73) Assignee: The Gaming Academy LLC, Fernandina Beach, FL (US)

( * ) Notice: Subject to any disclaimer, the term of this patent is extended or adjusted under 35 U.S.C. 154(b) by 468 days.

(21) Appl. No.: 12/422,237

(22) Filed: Apr. 10, 2009

(65) Prior Publication Data

US 2010/0261515 A1 Oct. 14, 2010

(51) Int. Cl.
*A63F 9/24* (2006.01)

(52) U.S. Cl. ..... 463/11; 273/274

(58) Field of Classification Search ..... 463/11, 463/13; 273/274, 292, 309
See application file for complete search history.

(56) References Cited

U.S. PATENT DOCUMENTS

| | | | | |
|---|---|---|---|---|
| 5,154,429 | A * | 10/1992 | LeVasseur | 273/292 |
| 5,636,843 | A | 6/1997 | Roberts | |
| 6,012,719 | A | 1/2000 | Webb | |
| 6,322,075 | B1 | 11/2001 | DeFranco | |
| 6,345,823 | B1 | 2/2002 | Webb | |
| 6,443,455 | B1 | 9/2002 | Webb | |
| 6,793,220 | B1 | 9/2004 | Feola | |
| 7,431,643 | B2 | 10/2008 | Dargue | |
| 2002/0017757 | A1 * | 2/2002 | Marchesani | 273/274 |
| 2007/0262524 | A1 | 11/2007 | Lambert | |
| 2008/0012224 | A1 | 1/2008 | Hall | |

* cited by examiner

*Primary Examiner* — Brook Kebede
(74) *Attorney, Agent, or Firm* — Muskin & Cusick LLC

(57) ABSTRACT

A method for implementing a casino wagering game to be implemented with physical cards or electronically using an electronic gaming machine. The player can split his or her hand into two smaller hands and a dealer can split his or her hand into two smaller hands. The player can make numerous wagers, such as whether combinations of the player's two hands and the dealer's two hand will form poker ranks.

20 Claims, 6 Drawing Sheets

WAGERING GAME

BACKGROUND OF THE INVENTION

Field of the Invention

The present inventive concept relates to a system, method, and computer readable storage, for playing a variation of a casino game.

SUMMARY OF THE INVENTION

It is an aspect of the present general inventive concept to provide for an exciting and profitable wagering game.

The above aspects can also be obtained by a method that includes (a) providing a physical deck(s) of cards; (b) receiving a first wager from a player; (c) dealing, from the deck(s) of cards, a player's original hand; (d) splitting, by the player, the player's original hand into a first player's hand and a second player's hand; (e) receiving an action by the player, the action comprising one of: 1) checking; 2) raising wherein the player places a raise wager; 3) switching wherein the player switches the first wager to be a second wager; (f) revealing an original community hand; (g) splitting the original community hand into a first community hand and a second community hand; (h) if the player did not switch, then determining if a hand formed by either the player's first hand and the dealer's second hand or the player's second hand and the dealer's first hand is greater than a first predetermined rank, and if so, then paying the first wager using a first paytable, (i) if the player did switch, then determining if the dealer's original hand matches or is greater than a second predetermined rank, and if so, then paying the second wager using a second paytable.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
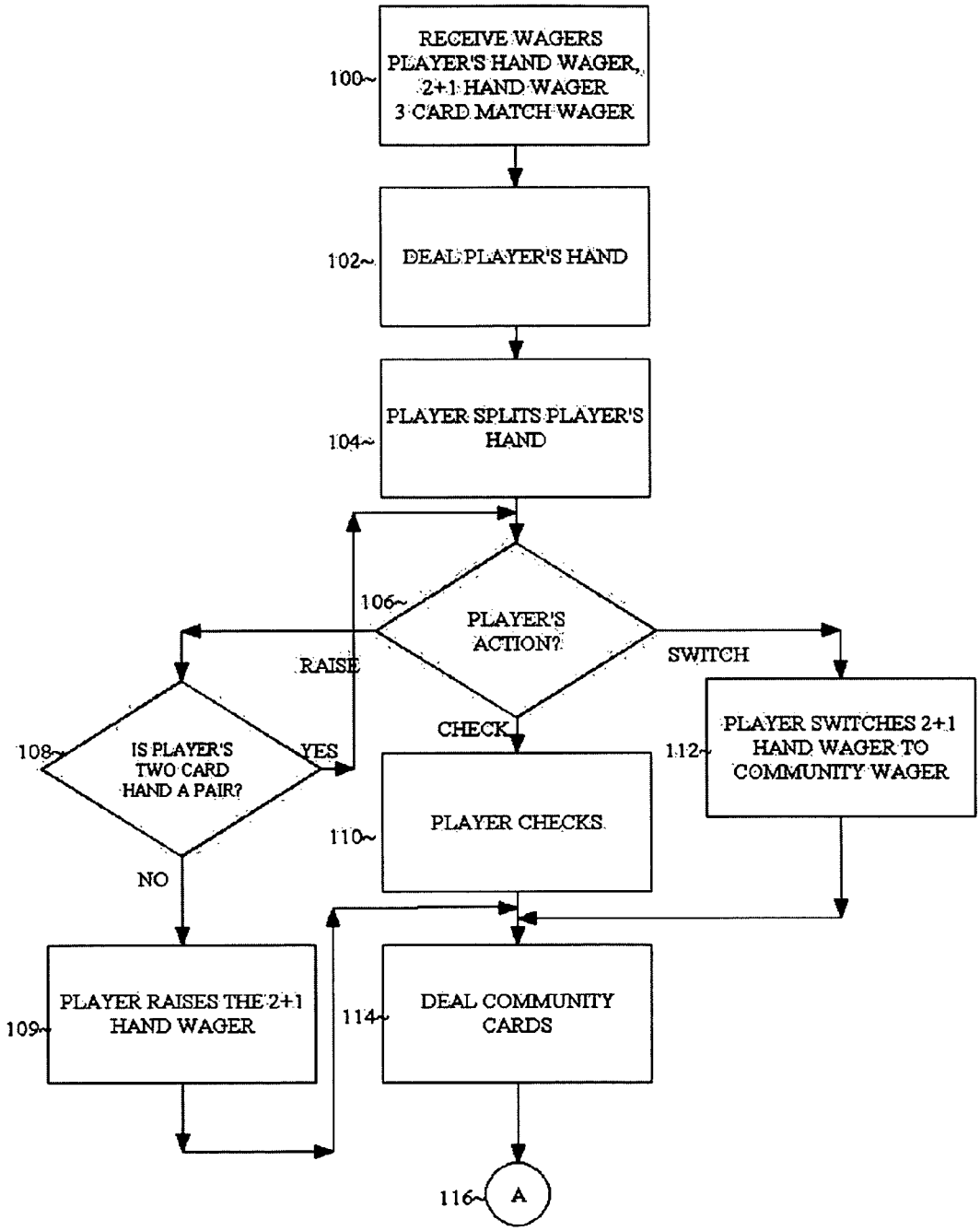
FIG. 1 is a flowchart illustrating an exemplary method of betting and dealing a wagering game, according to an embodiment.

Reference will now be made in detail to the presently preferred embodiments of the invention, examples of which are illustrated in the accompanying drawings, wherein like reference numerals refer to like elements throughout.

The general inventive concept relates to a wagering game which can be played either using physical cards and chips in a casino, or can be played electronically (either online or using an electronic gaming machine).

Table I below illustrates one exemplary set of rules. Of course, one would appreciate that this is merely one exemplary rule set, and other variations could be used as well.

Table I

1. The game is played with a standard deck of 52 playing cards.
2. Before play begins, each player must make two identical wagers: The "Player's Hand" wager and the "Two Plus One" wager. In addition, each player may make a third, optional "Three Card Match" wager.
3. To begin the round, the dealer will deal three cards, face down, to each player and three cards, face down, to himself.
4. Each player then splits their three cards into a lone card (hereafter referred to as the "Player's One Card Hand") and a pair of cards (hereafter referred to as the "Player's Two Card Hand"), and places them face down on the table.
5. Each player then may decide whether to check and make no further bets or to raise his Two Plus One wager by placing an amount equal to his Two Plus One wager on the appropriate space on the layout, but only if the player's Two Card Hand is not a pair.
6. If the player does not check or raise, they may choose to switch their Two Plus One wager into a Community Hand wager.
7. Once all players have set their hand accordingly, the dealer will separate his top two cards (hereafter referred to as the "Community Two Card Hand") from the remaining card (hereafter referred to as the "Community One Card Hand"), and settle the wagers in the following manner:

7(a). First, the dealer will determine whether the player's hand is "Matched" or "Unmatched" by the Community Hand.

7(a)(i). If the three Community cards form a hand of the same, or greater, three card poker rank as the Player's Hand, the Player's Hand is said to be "Matched". Otherwise, the Player's Hand is said to be "Unmatched". "Rank" refers to the general hand rank (One Pair, Trips or so forth) as opposed to the exact hand rank.

7(b). If the Player Hand constitutes at least One Pair or better, they will be paid according to the appropriate paytable, depending on whether their hand is considered Matched or Unmatched.

7(c). If the Two Plus One Wager constitutes either the Player's One Card Hand combined with the Community Two Card Hand, or the Player's Two Card Hand combined with the Community One Card Hand, can combine to One Pair or better, the player will be paid according to the Two Plus One paytable (where a payout of "0" on the One Pair paytable represents a push); otherwise, the Two Plus One wager will lose.

7(c)(i). Only the highest hand of the two Two Plus One Hands will be paid

7(d). If the player switched their Two Plus One wager to the Community wager, and the Community cards constitute at least One Pair or better, the player will be paid according to the Community paytable.

7(e). If the player made the optional Three Card Match wager, and the player's Hand constitutes at least One Pair or better, and the Player's Hand is considered Matched, they will be paid according to the Three Card Match paytable.

8. Once all wagers are settled, the dealer will collect all cards to conclude the round.

The rules in Table I can be varied accordingly. For example, in Table I, 7(c), instead of the cards combining to form one pair or better to form a winning hand, the cards must form a flush or better. Additionally, having a pair can be an optional push, according to house rules. Otherwise, if no winning hand is formed, then the Two Plus One Wager results in a loss.

FIG. 1 is a flowchart illustrating an exemplary method of betting and dealing a wagering game, according to an embodiment.

The method can begin with operation 100, wherein each player places his or her wagers. The player must place a player's hand wager and a 2+1 wager of equal amounts. In an alternate embodiment, the wager amounts do not need to be equal. In a further alternate embodiment, the player may be allowed to place only one of these wagers, at the player's option. In addition to the wagers described, the player may also make an optional three card match wager.

From operation 100, the method proceeds to operation 102, wherein the dealer deals the player's hand. The player's hand would be formed of exactly three cards. In another embodiment, the player's hand could be formed using any number of cards (e.g., 1-10 cards). The player's hand can be dealt face up or face down, as long as each player can view their respective player's hand.

From operation 102, the method proceeds to operation 104, wherein the player splits the player's hand into two separate hands. The player will view his or her cards (the players hand dealt in operation 102) and based on these cards, the player will divide his or her original three card hand into a one card hand and a two card hand. The player will choose which card to use for the one card hand and which cards to use for the two card hand based on a playing strategy which the player thinks will give the player the best return on his or her wagers. The player can place each of these two separate hands in a respective area on the table (see FIG. 5). If the embodiment being implemented uses a different number of cards for the player's hand than three, then the hand can be split into two hands according to house rules. For example, if the player's hand is formed using exactly four cards, then the hand can be split into a one card hand and a three card hand, or two two card hands. Any suitable hand size for the split hands can be used as long as they of course total the original number of cards dealt for the player's hand.

From operation 104, the method proceeds to operation 106. The player now can take at least three courses of action: raise; check, or switch. The player can indicate to the dealer his or her course of action by verbally telling the dealer and/or using hand signals. If the player is playing an electronic version, then the player can indicate his or her course of action for example by pressing buttons, pressing an appropriate portion of a touch-screen monitor, or clicking a respective area of the screen using a mouse, etc.

If the player decides to raise the 2+1 wager, then the method proceeds to operation 108, which determines whether the player's two card hand is a pair. If the player's two card hand is a pair, then the player is not allowed to raise the 2+1 wager, and thus the method returns to operation 106 so that the player can decide to check or switch. This operation is optional, according to house rules.

If the player's two card hand is not a pair, then the method proceeds to operation 109, wherein the player raises the 2+1 wager by placing a raise wager equal in amount to the 2+1 wager placed in operation 100. From operation 109, the method proceeds to operation 114.

If in operation 106 the player decides to check, then the method proceeds to operation 110, wherein the player checks (does not place an additional wager). The method then proceeds to operation 114.

If in operation 106 the player decides to switch, the player then switches (moves) his or her 2+1 hand wager to instead be a community wager. This can be done by the player physically moving the chips from the 2+1 hand wager betting circle to the community wager betting circle, or having the dealer make this change. Thus, after the switch, the original 2+1 wager (made in operation 100) is now the community wager and the player no longer has a 2+1 wager present. From operation 112, the method proceeds to operation 114.

In operation 114, the dealer deals three community cards. In an alternate embodiment, any number of community cards can be dealt (e.g., 1-10 cards). The community cards can also be considered to be a dealer's hand or dealer's cards. At this stage, the community cards can be dealt up since the player's action is now complete. The community cards can alternatively be dealt at an earlier point in the game, although they should be dealt face down until the player has completed his or her actions in operations 106-112, upon which the community cards can then be revealed.

The dealer splits the three community cards into a two separate hands, a community two card hand (using two of the cards) and a community one card hand (using the remaining one of the cards). The split can be made in the order the cards are dealt, e.g., the first two community cards dealt are used for the two card hand and the third community card dealt is used for the one card hand (or vice-versa). The split can also be made according to a house way (e.g., the highest card is used for the one card hand while the remaining cards are used for the two card hand).

In an alternative embodiment, the community cards can be formed using a different number of cards instead of three (e.g., 2, 4-7, etc.) These cards can then be split using the same methodology as described above for the three community cards.

Figure 2:
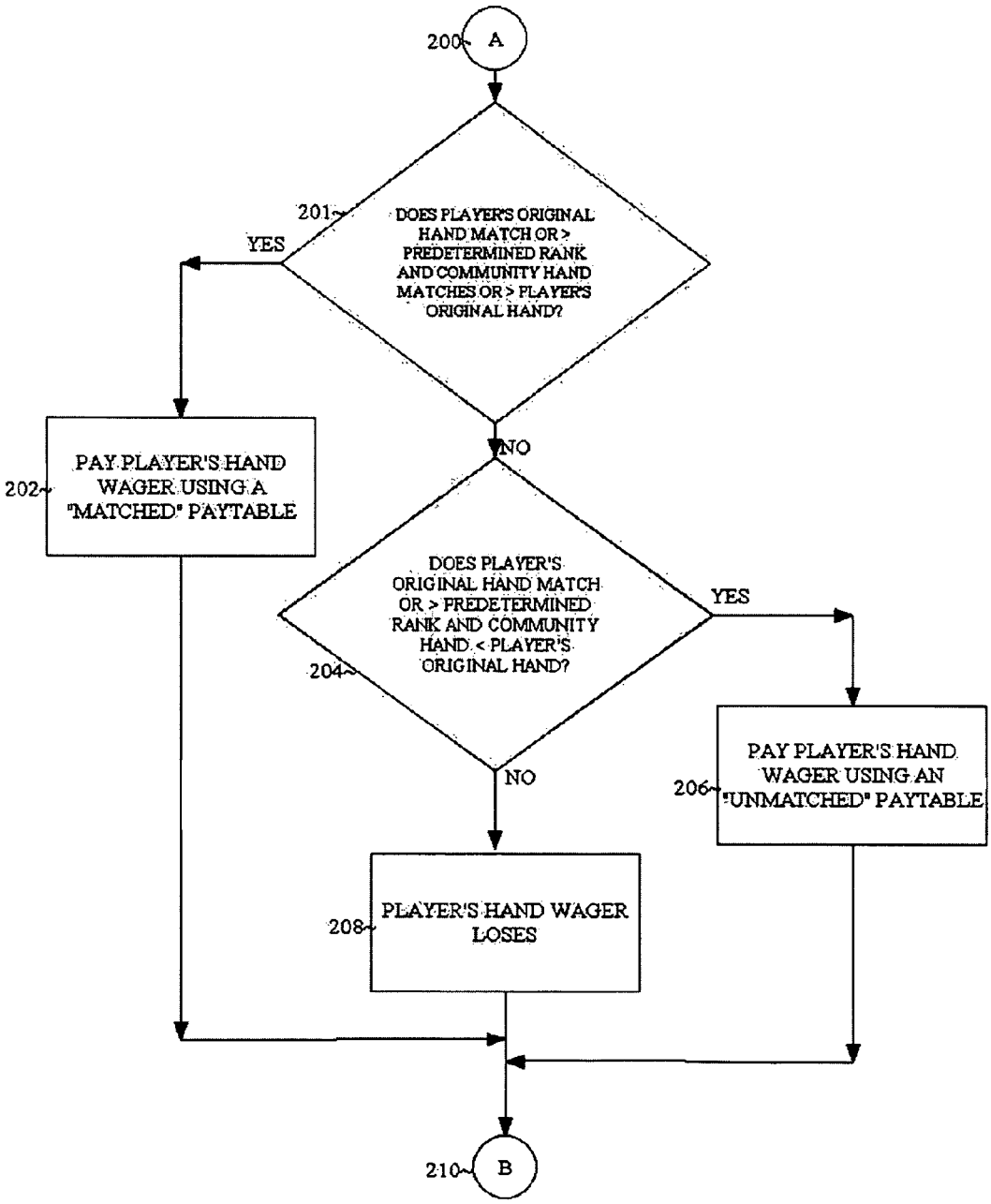
FIG. 2 is a flowchart illustrating an exemplary method of resolving a player's hand wager, according to an embodiment.

From operation 114, the method connects to connector A 116 which continues to connector A 200 in FIG. 2.

FIG. 2 is a flowchart illustrating an exemplary method of resolving a player's hand wager, according to an embodiment. The method resumes form connector A 200. Thus, after operation 114, the method proceeds to operation 201.

In operation 201, it is determined whether the player's original hand (all cards originally dealt in operation 102) matches or beats a predetermined rank (e.g., one pair) and if the community hand matches or beats the player's original hand. The predetermined rank of one pair can be changed according to the embodiment being implemented to any other rank.

If both conditions from operation 201 are true, then the method proceeds to operation 202, which pays the player's hand wager using a paytable (e.g., see Table II, player hand matched). Thus, this point (a "matched" hand) in the method is reached if the player's hand is greater than or equal to the predetermined rank and the player's hand is less than (ranks lower than) or equal to the community hand. If the player made the optional three card match wager (in operation 100), then this wager is also paid using a paytable (e.g., see Table II, three card match). The method then proceeds to connector B 210.

It is noted that the determination of whether the community hand matches or beats the player's original hand in operation

201 is made based on the actual category of hand (e.g., a pair, three of a kind, etc., see the first column in table II for hand categories) without regard to the individual makeup of that hand. For example, if the player's original hand is three 5's and the community hand is three 3's, then the community hand (three 3's) matches or beats the player's original hand (three 5's) because both hands match the same category (three of a kind) and thus it is a match. If the community hand was a straight flush then it would beat the player's original hand of three 5's. Therefore, for the purposes of this determination, three 2's would be equivalent as three kings when determining a match because the hand category is what is used. Thus, the resolution of the player's hand wager and the three card match wager is based on this determination. It is further noted that in an alternate embodiment, the individual makeup of the hands can be used in determining whether the community hand matches or beats the player's original hand, as typically done in standard poker rank comparisons. In this embodiment, for example, a community hand of three 2's would not match or beat a player's hand of three 5's because using standard poker rankings, three 2's ranks lower than three 5's.

If in operation 201, both conditions are not true, then the method proceeds to operation 204, which determines whether the player's original hand matches or beats the predetermined rank (e.g. one pair) and the community hand rank is lower than the player's original hand rank. If both conditions are not true, then the method proceeds to operation 208, wherein the player's hand wager loses (is not paid) and is or will be taken by the dealer. If the player made the three card match wager (in operation 100) then the three card match wager would also lose and be taken by the dealer. From operation 208, the method proceeds to connector B 210.

If both conditions from operation 204 are true, then the method proceeds to operation 206, which pays the player's hand wager using an "unmatched" paytable (e.g., see Table II, player's hand unmatched). If the player made the three card match wager (in operation 100) then the three card match wager would lose and be taken by the dealer. The method then proceeds to connector B 210.

Figure 3:
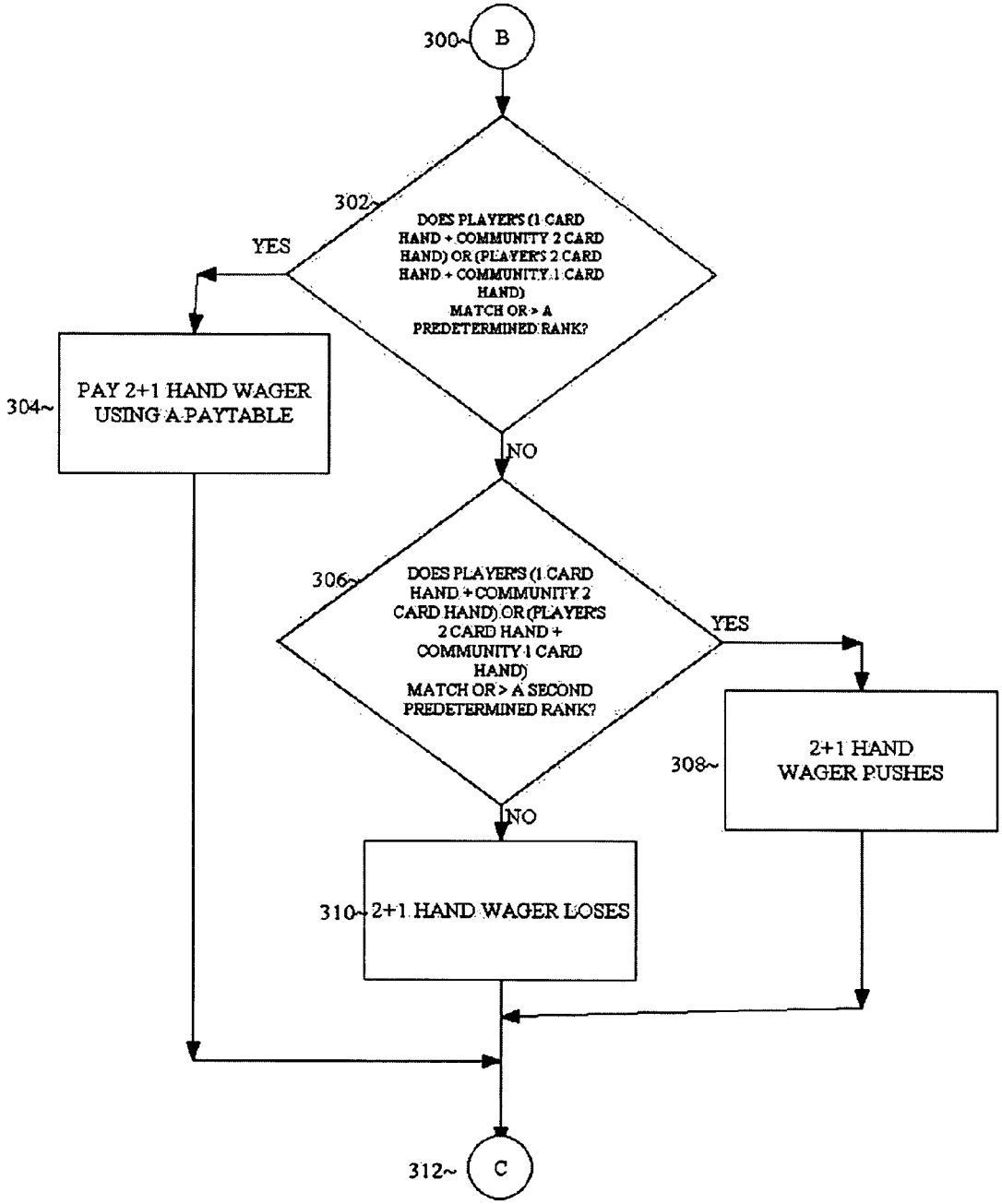
FIG. 3 is a flowchart illustrating an exemplary method of resolving a 2+1 wager, according to an embodiment.

FIG. 3 is a flowchart illustrating an exemplary method of resolving a 2+1 hand wager, according to an embodiment.

From connector B 300 the method proceeds to operation 302 which determines whether the player's one card hand combined with the community two card hand or the player's two card hand combined with the community one card hand matches or is greater than a predetermined rank (e.g., one pair). If this condition is true, then the method proceeds to operation 304, which pays the 2+1 hand wager (and any raise wager, if made) using a respective 2+1 paytable (see Table II, "two plus one").

If the condition in operation 302 is not true, then the method can proceed to operation 306, which determines whether the player's one card hand combined with the community two card hand or the player's two card hand combined with the community one card hand matches or is greater than the predetermined rank (e.g., one pair). If so, the method can proceed to operation 308, wherein the player's 2+1 hand wager pushes (neither wins or loses and is left alone by the dealer).

If the condition in operation is not true, then the method proceeds to operation 310, wherein the player's 2+1 hand wager loses (is taken by the dealer).

From operations 304, 308, 310, the method proceeds to connector C 312 as illustrated in FIG. 3.

Figure 4:
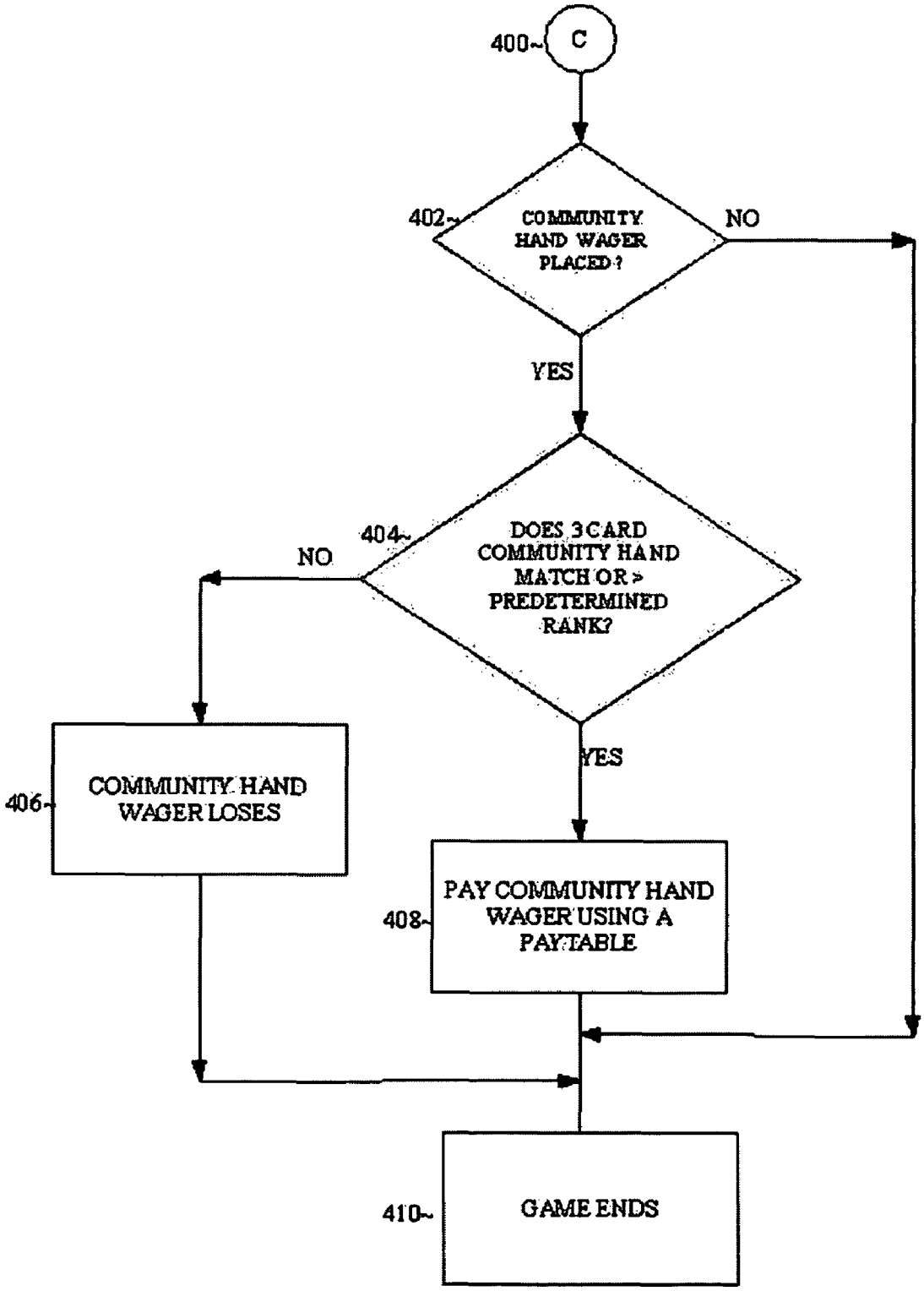
FIG. 4 is a flowchart illustrating an exemplary method of resolving a community hand wager, according to an embodiment.

FIG. 4 is a flowchart illustrating an exemplary method of resolving a community hand wager, according to an embodiment.

From connector C 400 the method continues to operation 402, which determines whether the community hand wager was placed (this wager may be optional, depending on house rules). If the community wager was not placed, then the game is over and the method proceeds to operation 410.

If the community hand wager was placed, then the method proceeds to operation 404, which determines whether the three card community hand matches or is greater than a predetermined rank (e.g., one pair). If the three card community hand ranks less than one pair, then the method proceeds to operation 406, wherein the community hand wager loses and the method then proceeds to operation 410.

If, in operation 404, the three card community hand matches or is greater than the predetermined rank (e.g., one pair), then the method proceeds to operation 408, which pays the community hand wager using a respective paytable (e.g., see Table II, community column). The method can then proceed to operation 410.

In operation 410, the game is terminated. All winning bets are paid according to their respective payouts (if not paid already), and all losing bets are taken by the house (if not already taken). Bets that push (tie) are not taken or paid, but can be returned to (or taken back by) the player. All of the cards used in the game can now be collected and returned to a discard tray. The deck(s) may or not be shuffled again (according to house rules) before a new game is begun, upon which the method can then return to operation 100.

Table II below illustrates paytables used to determining winning payouts on each of the types of wagers (Player Hand, 2+1, Community, Three Card Match). Of course this reflects just one possible set of payouts, and one skilled in the art would appreciate that other payouts could be used as well. Note that in Table II, ranks are listed in order of lowest (or worst) rank (bottom—no pair) to the highest (or best) rank (top—three card royal). As known in the art, a three card royal is an ace, king, queen, all of the same suit (e.g., ace clubs, king clubs, queen clubs). A straight flush are three sequential cards all in the same suit (an ace may count as high (11) or low (1)) but not ace, king, and queen (e.g., ten diamonds, nine diamonds, eight diamonds). "Trips" (also known as three of a kind) are three cards of the same denomination (e.g., queen clubs, queen hearts, queen diamonds). A straight is any three cards in sequence (but not all of the same suit), an ace may count as high (11) or low (1), (e.g., ace clubs, queen spades, king hearts). A flush is three cards of the same suit but not in sequence (e.g., king spades, two spades, three spades). A "one pair" is two cards (but not three) of the same denomination (e.g., ten hearts, ten diamonds, three clubs). A "no hand" (or "no pair") is three odd cards (e.g., nine clubs, six clubs, three hearts). These poker ranks are well known in the art.

TABLE II

| | Player Hand (Matched) | Player Hand (Unmatched) | Two Plus One | Community | Three Card Match |
|---|---|---|---|---|---|
| Three Card Royal | 1,000 | 100 | 20 | 20 | 20,000 |
| Straight Flush | 400 | 40 | 8 | 8 | 5,000 |
| Trips | 150 | 15 | 4 | 4 | 1,000 |
| Straight | 15 | 6 | 1 | 3 | 200 |
| Flush | 5 | 3 | 1 | 2 | 40 |
| One Pair | 2 | 1 | 0 | 1 | 10 |
| No Hand | −1 | −1 | −1 | −1 | −1 |

According to a mathematical analysis of the game exemplified in Table I: the house will win, on average, an amount equal to 3.05% of the total amount bet on the player hand wager. Assuming the player employs optimal strategy, the house will win, on average, an amount equal to 2.19% of the total amount of the 2+1 (two plus one) and the Raise wagers. When the Three Card Match wager is played in a non-progressive fashion, the house will win, on average, an amount equal to 5.91% of the amount bet on the Three Card Match wager. No representation is made that any of the calculations presented herein are entirely accurate as it is possible errors could have been made in the analysis and in any case the mathematical analysis is presented merely for informational purposes and does not affect the true spirit and scope of the invention.

The optimal player strategy for playing the game exemplified in Table I is as follows. The player should raise (in operation 106) when the player can make a two card hand of any of: 1) any two cards in a three card royal (when dealt a three card royal, the player should play the queen and king together in the two card hand); 2) any open draw to a straight flush or better; 3) any closed draw at a straight flush or better, unless the player's hand includes a pair. The player should check when the player can make a two card hand of any of: 1) any pair; 2) any two cards of the same suit; 3) any open draw to a straight. If the player cannot make any of the above two card hands, then the player should switch.

Figure 5:
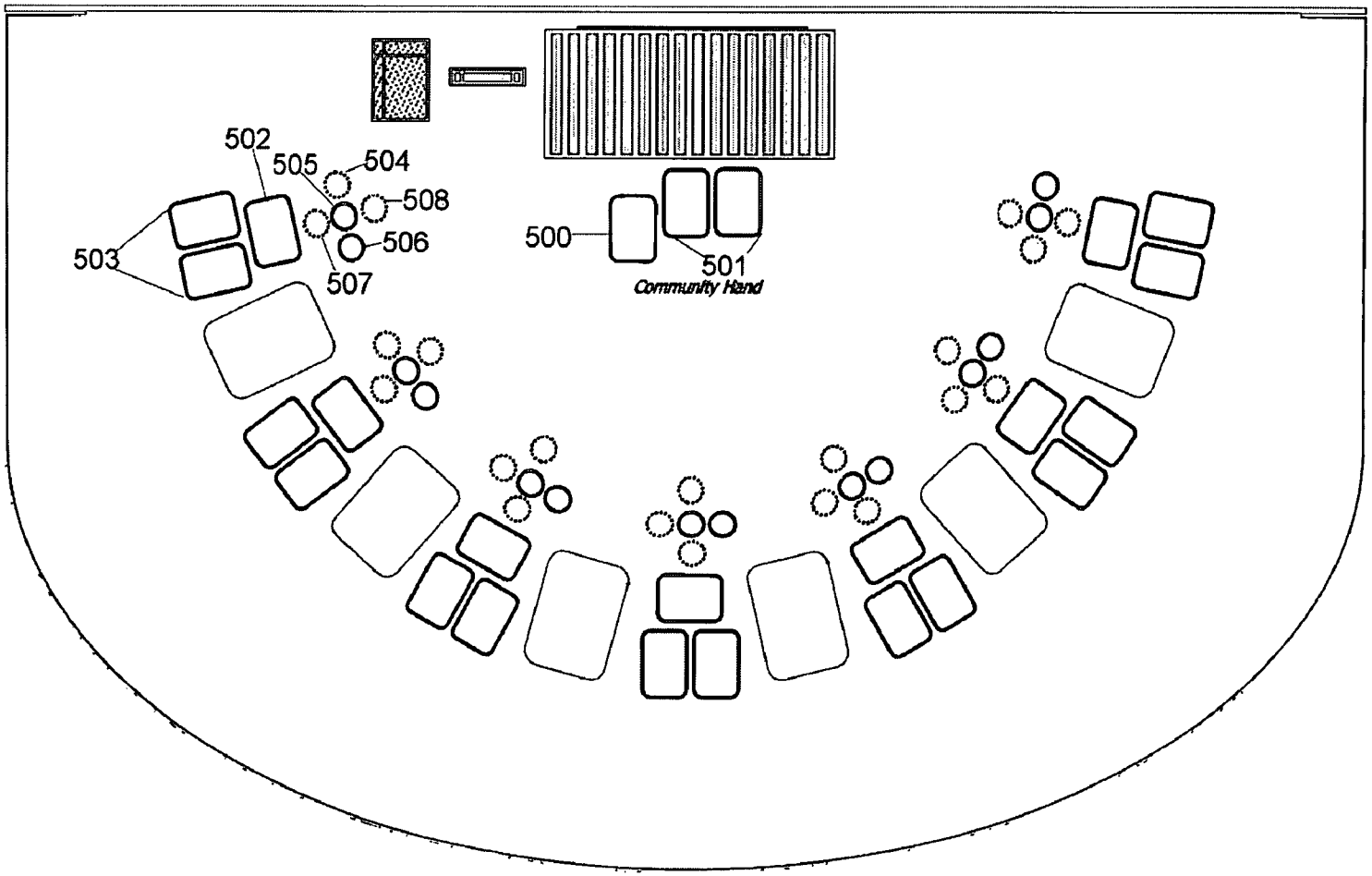
FIG. 5 is a drawing illustrating an exemplary table layout, according to an embodiment.

FIG. 5 is a drawing illustrating an exemplary table layout, according to an embodiment.

The layout illustrated in FIG. 5 can accommodate seven simultaneous players, although of course other layouts can accommodate any reasonable number of players. The community (or dealer's) hand is in the center and comprises a community one card hand (also called one card community hand) 500 and a community two card hand (also called two card community hand) 501. The initial community hand dealt in operation 114 would deal all three of these cards.

In the seventh (numbered from left to right as seven to one, respectively) player's position on the table (out of the seven positions), there is a player's one card hand 502 and a player's two card hand 503. When the player views the player's originally dealt hand (from operation 102), the player (in order to make it clear how the player splits his or her hand) in operation 104 will place his or her chosen one card hand in box 502 and his or her chosen two card hand in boxes 503. This way there is no ambiguity (or potential for cheating) as to how the player has split (set) his or her hand.

A player's hand wager betting circle 506 and a 2+1 hand wager betting circle 505 are used to receive these respective wagers (in operation 100) A raise wager betting circle 507 is used to place the raise wager (in operation 109). A community wager betting circle 504 is used when (in operation 112) the player switches the 2+1 wager to the community wager (by sliding the chips from the 2+1 wager betting circle 505 to the community wager betting circle 504). Also shown is a three card match bet betting circle (for each player) 508 which is used to place the three card match bet.

An example game will now be presented, using the rules in Table I. Joe places a $1 wager on the player's hand betting circle and an equal $1 wager on the 2+1 wager betting circle. The dealer deals Joe the following three cards: king spades/king clubs/3 diamonds. Joe splits his hand such that the king spades/king clubs are the player's two card hand and the 3 diamonds is the player's one card hand. The player further decides to check (at this point in the game Joe does not know any of the dealer's cards). The dealer then deals the dealer's three cards face up: 4 hearts/5 clubs/10 diamonds. The dealer sets his hand as follows: the dealer's two card hand is the 4 hearts/5 clubs and the dealer's one card hand is the 10/diamonds. Since the player's original three card hand matches or is better than a predetermined rank of one pair and the community hand ranks lower than the player's original hand, then the player wins a payout on the player's hand wager (in operation 206) which is paid at 1:1 (from Table II) or the player wins $1 on the player's hand wager. With regard to the 2+1 wager, the player's one card hand (3 diamonds) with the dealer's two card hand (4 hearts/5 clubs) combine to make a straight which is greater than a predetermined rank of one pair. Therefore, the 2+1 wager is paid according to Table II pays 1:1 or $1. The game is now over. Thus, Joe had original bet $2 (the $1 player's hand wager and the $1 2+1 wager) and has been paid $2 ($1 on the player's hand wager and $1 on the 2+1 wager), thus Joe now has a total of $4 of his chips on the table ($2 profit). Joe takes all of his chips and can bet for a new game.

Another example will now be presented, using the rules in Table I. Jane places a $2 wager on the player's hand betting circle, and an equal $2 wager on the 2+1 betting circle. Jane also decides to place a $1 three card match wager. The dealer deals Jane the following three cards: five clubs/six clubs/10 spades. Jane splits her hand such that her two card hand is: five clubs/six clubs, and her one card hand is: 10 spades. Jane decides to raise the 2+1 wager, and so she places another $2 wager on the raise wager betting circle. The dealer now deals (or reveals if they have already been dealt) the dealer's cards for all to see: 2 hearts/9 hearts/4 clubs. The dealer sets his or her cards in the order they were dealt: the dealer's two card hand is the 2 hearts/9 hearts, and the dealer's one card hand is the 4 clubs. The dealer now resolves the wagers (the wagers can be resolved in any order). With regard to the player's hand wager, the player's hand is a 10-high. This does not match one pair, and thus Jane loses her $2 player's hand wager. Since Jane's hand is not a pair or higher, Jane also loses her $1 three card match wager. With regard to the 2+1 wager, combining the player's one card hand (10 spades) with the dealer's two card hand (2 hearts/9 hearts) results in only a 10 high ranking. Combining the player's two card hand (five clubs/six clubs) with the dealer's one card hand (4 clubs) forms a straight flush. According to the 2+1 paytable in Table II, a straight flush pays 8:1, thus Jane is paid $32 (8 times 4) on her $2 2+1 wager and her $2 raise wager. The game is now over. Jane had placed $7 in wagers (The $2 player's hand wager, the $2 2+1 wager, the $1 three card match wager, and the $2 raise wager) and has been paid out $32 on the 2+1 wager and the raise wager. The dealer takes the losing $2 player's hand wager and the losing $1 three card match wager). Thus, the player has wagered $7, gets paid $32, loses $3, for a total of $36 remaining on the table, or a $29 net profit.

An additional example will now be presented, using the rules in Table I. Mike places a $1 player's hand wager and a $1 2+1 wager. Mike decides to decline to place the three card match wager. Mike is dealt a three hearts/queen clubs/6 diamonds. Mike decides to set his hand as follows: three hearts/6 diamonds for the player's two card hand and uses the queen clubs for the player's one card hand. The player decides to switch, and thus changes the $1 2+1 wager from the 2+1 betting circle to the community wager betting circle, thereby effective transferring his 2+1 wager to be a community wager instead. The dealer now deals the dealer's hand: 8 spades/9 spades/5 spades. The dealer sets his hand as follows: the dealer's two card hand is: 8 spades/9 spades, and the dealer's one card hand is: 5 spades. The player's original hand (Mike's original hand) of three hearts/queen clubs/6 diamonds ranks as queen high. Since this is less than a pair, Mike's player's hand wager loses. The three card community hand (also considered a "dealer's hand") is 8 spades/9 spades/5 spades, which ranks in poker as a flush. According to paytable II, a flush pays 2:1. Thus, the community wager wins $2. Thus, the dealer takes Mike's losing $1 player's hand wager, and pays Mike's winning community wager $2. Thus, Mike has originally bet $2, has $1 in wagers taken away (the losing player's hand wager), while getting paid an additional $2 on the winning community wager, therefore resulting in $3 on the table, or a $1 net profit for Mike.

One final example will now be presented. Dave places a $1 player's hand wager, a $1 2+1 wager, and a $1 three card match wager. Dave is dealt 5 diamonds/5 clubs/10 diamonds. Dave splits his hand as follows: 5 diamonds/5 clubs as the two card hand, and the 10 diamonds as the one card hand. Dave decides to check. The dealer now deals the dealer's hand: 2 hearts/3 hearts/4 hearts. The dealer sets his own hand as follows: 2 hearts/3 hearts for the two card hand, and 4 hearts for the one card hand. Since Dave's original three card hand (one pair) matches a predetermined rank of a pair, and the community (dealer's) hand (straight flush) is greater than the player's original hand, then Dave wins the player's hand wager using the "matched" paytable (since it is matched). Thus, from Table II, one pair pays 2:1 and thus Dave wins $2 on the player's hand wager. Since the player's hand is matched, the three card match wager pays 10:1 and thus the $1 three card match wager is paid $10. Regarding the 2+1 wager, the best hand combining the player's hand and the dealer's hand is using the player's two card hand (pair of 5's) with the dealer's one card hand (4 hearts). From Table II, one pair for the 2+1 wager pushes, so Dave does not win or lose his 2+1 wager. Therefore, Dave bet $3 originally, was paid $2 on the player's hand wager and $10 on the three card match wager, and thus made a $12 net profit.

Figure 6:
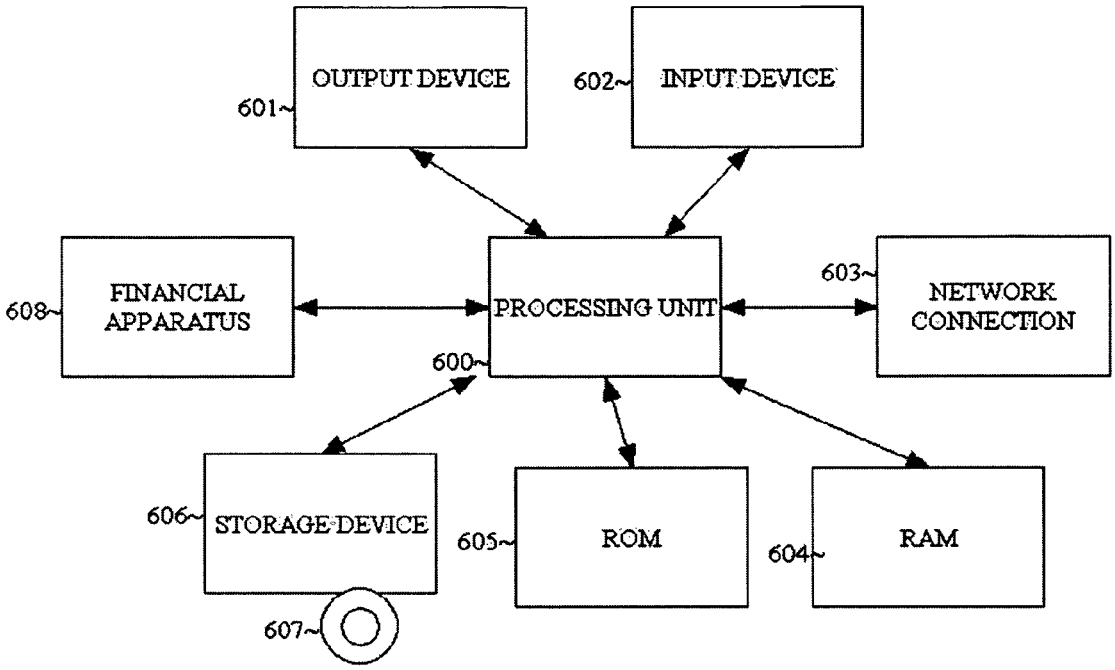
FIG. 6 is a block diagram illustrating sample hardware that can be used to implement an electronic version of the methods described herein, according to an embodiment.

FIG. 6 is a block diagram illustrating sample hardware that can be used to implement an electronic version of the methods described herein, according to an embodiment. Electronic versions of the game can be played on an electronic gaming device or online using a computer client connected to the Internet.

A processing unit 600 (such as a microprocessor and associated components) can be connected to an output device 601 such as a touchscreen, CRT, plasma display, etc. The processing unit 600 is also connected to an input device, such as a touchscreen, keyboard, mouse, etc. The processing unit 600 is also connected to a network connection 603 which can connect to any type of computer communications network, such as a LAN, WAN, the Internet, etc. The processing unit 600 is also connected to a RAM 604 and a storage device 605 which can be a ROM, hard drive, CD-ROM, DVD drive, or any known storage device. Computer readable storage medium 606 can be a CD, DVD, etc., which stores assets (programs, media files, etc.) which can be used to control a computer to implement the methods described herein. The processing unit 600 can also be connected to a financial apparatus 607 which on an electronic gaming device located in a casino can be used to collect cash from a player and to pay payouts to the payer (either in the form of cash, coins, tickets, or electronic payouts).

It is noted that the methods described herein can be played using any number of physical decks (e.g., 1-8 or more). Standard decks of 52 cards can be used, as well as other kinds of decks, such as Spanish decks, decks with wild cards jokers), etc. The operations described herein can be performed in any sensible order. Furthermore, numerous different variants of house rules can be applied. For example, the dealer can hit on soft 17 or stand on soft 17, depending on house rules. Cards can be given their standard point values as known in the art (e.g., 2-10 have their face value, jack, queen, and king, have a point value of 10, and ace has a point value of 1 or eleven). The terminology "less than or equal to" or similar language corresponds to the ≦ operator, and "greater than or equal to" or similar language corresponds to the ≧ operator.

Wagers placed by the player can be placed in the form of cash or chips which are redeemable for cash. When the player loses a wager, the chip(s) are physically collected by the dealer. When the player wins a wager, the chip(s) are physically paid by physically moving chips in the dealer's possession to the player's betting circle.

In addition to chips, other equipment can be used as well, such as standard gaming tables with table felts indicating the betting circles, card shuffles, card shoes, etc.

The descriptions provided herein also include any hardware and/or software known in the art and needed to implement the operations described herein. Further, all methods described herein can be programmed on a digital computer and stored on any type of computer readable storage medium. If there are any inconsistencies between the description of a feature in this document, it just means that the feature can be implemented in either stated manner.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method to play a wagering game, the method comprising:

providing a physical deck(s) of cards;

receiving a first wager from a player;

dealing, from the deck(s) of cards, a player's original hand;

enabling the player to split the player's original hand into a first player's hand and a second player's hand;

receiving an action by the player, the action comprising one of: 1) checking; 2) raising wherein the player places a raise wager; 3) switching wherein the player switches the first wager to be a second wager;

revealing an original community hand;

splitting the original community hand into a first community hand and a second community hand;

if the player did not switch, then determining if a hand formed by either the player's first hand and the second community hand or the player's second hand and the first community hand is greater than a first predetermined rank, and if so, then paying the first wager using a first paytable, if the player did switch, then determining if the original community hand matches or is greater than a second predetermined rank, and if so, then paying the second wager using a second paytable.

2. The method as recited in claim 1, wherein if the player did not switch and if a hand formed by either the player's first hand and the second community hand or the player's second hand and the first community hand is not greater than a first predetermined rank, then the first wager pushes or loses.

3. The method as recited in claim 1, wherein if the player did switch, then if the original community hand does not match or is greater than a second predetermined rank, then the second wager pushes or loses.

4. The method as recited in claim 1, wherein the first predetermined rank equals the second predetermined rank.

5. The method as recited in claim 1, wherein the first predetermined rank does not equal the second predetermined rank.

6. The method as recited in claim 1, wherein the first paytable is equal to the second paytable.

7. The method as recited in claim 1, wherein the first paytable does not equal the second paytable.

8. The method as recited in claim 1, wherein if the first wager is paid then the raise wager is also paid using the first paytable.

9. The method as recited in claim 1, further comprising:

before the dealing, receiving a third wager from the player;

after the revealing, if the player's original hand matches or is greater than a third predetermined rank and the original community hand matches or is greater than the players original hand then the third wager is paid using a third paytable, if the player's original hand matches or is greater than a third predetermined rank and the original community hand is less than the players original hand, then the third wager is paid using a fourth paytable, if the player's original hand is less than the third predetermined rank then the third wager loses.

10. The method as recited in claim 1, further comprising:

before the dealing, receiving a fourth wager from the player;

after the revealing, if the player's original hand matches or is greater than a third predetermined rank and the original community hand matches or is greater than the players original hand then the fourth wager is paid using a fourth paytable, otherwise the player loses the fourth wager and the fourth wager is taken from the player.

11. An electronic gaming machine apparatus programmed to play a wagering game, the apparatus comprising:

an electronic processing unit, configured to perform:

receiving a first wager from a player;

dealing, from a deck(s) of cards, a player's original hand;

enabling the player to split the player's original hand into a first player's hand and a second player's hand;

receiving an action by the player, the action comprising one of: 1) checking; 2) raising wherein the player places a raise wager; 3) switching wherein the player switches the first wager to be a second wager;

revealing an original community hand;

splitting the original community hand into a first community hand and a second community hand;

if the player did not switch, then determining if a hand formed by either the player's first hand and the second community hand or the player's second hand and the first community hand is greater than a first predetermined rank, and if so, then paying the first wager using a first paytable, if the player did switch, then determining if the original community hand matches or is greater than a second predetermined rank, and if so, then paying the second wager using a second paytable; and an electronic output unit to display results of the processing unit.

12. The apparatus as recited in claim 11, wherein if the player did not switch and if a hand formed by either the player's first hand and the second community hand or the player's second hand and the first community hand is not greater than a first predetermined rank, then the first wager pushes or loses.

13. The apparatus as recited in claim 11, wherein if the player did switch, then if the original community hand does not match or is greater than a second predetermined rank, then the second wager pushes or loses.

14. The apparatus as recited in claim 11, wherein the first predetermined rank equals the second predetermined rank.

15. The apparatus as recited in claim 11, wherein the first predetermined rank does not equal the second predetermined rank.

16. The apparatus as recited in claim 11, wherein the first paytable is equal to the second paytable.

17. The apparatus as recited in claim 11, wherein the first paytable does not equal the second paytable.

18. The apparatus as recited in claim 11, wherein if the first wager is paid then the raise wager is also paid using the first paytable.

19. The apparatus as recited in claim 11, wherein the processing unit further performs:

before the dealing, receiving a third wager from the player;

after the revealing, if the player's original hand matches or is greater than a third predetermined rank and the original community hand matches or is greater than the players original hand then the third wager is paid using a third paytable, if the player's original hand matches or is greater than a third predetermined rank and the original community hand is less than the players original hand, then the third wager is paid using a fourth paytable, if the player's original hand is less than the third predetermined rank then the third wager loses.

20. The apparatus as recited in claim 11, wherein the processing unit further performs:

before the dealing, receiving a fourth wager from the player;

after the revealing, if the player's original hand matches or is greater than a third predetermined rank and the original community hand matches or is greater than the players original hand then the fourth wager is paid using a fourth paytable, otherwise the player loses the fourth wager and the fourth wager is taken from the player.

* * * * *